US005255801A

United States Patent [19]

Berger

[11] Patent Number: 5,255,801

[45] Date of Patent: Oct. 26, 1993

[54] FREE-STANDING MERCHANDISE DISPLAY

[75] Inventor: Barry D. Berger, New York, N.Y.

[73] Assignee: RGA Accessories, Inc., Jersey City, N.J.

[21] Appl. No.: 575,163

[22] Filed: Aug. 30, 1990

[51] Int. Cl.[5] ..... A47F 5/00

[52] U.S. Cl. ..... 211/131; 211/71; 211/163

[58] Field of Search ..... 211/131, 78, 163, 196, 211/205, 129, 56, 58, 71

[56] References Cited

U.S. PATENT DOCUMENTS

| | | | |
|---|---|---|---|
| 2,953,257 | 9/1960 | McNeill | 211/131 |
| 3,543,943 | 12/1970 | Joy | 211/131 |
| 3,568,854 | 3/1971 | Welch | 211/163 |
| 4,072,235 | 2/1978 | Munoz | 211/71 |
| 4,216,867 | 8/1980 | Sturm | 211/131 X |
| 4,609,975 | 9/1986 | Badolato et al. | 211/131 X |
| 4,736,856 | 4/1988 | Alneng et al. | 211/131 |
| 4,946,048 | 8/1990 | Francois | 211/163 X |
| 4,964,520 | 10/1990 | Kilmartin | 211/163 X |

*Primary Examiner*—Robert W. Gibson, Jr.

*Attorney, Agent, or Firm*—Brumbaugh, Graves, Donohue & Raymond

[57] ABSTRACT

A free-standing merchandise display comprises a base adapted to rest stably on a horizontal surface and a pole extending vertically upwardly from the base. An elongated, substantially circular cylindrical tower is rotatably mounted on the pole. Elongated merchandise trays extend lengthwise generally radially outwardly from the tower. Each tray has a bottom wall, at least portions of which form a planar surface for supporting the merchandise, side walls extending upwardly from each of the longer sides of the bottom wall and an end wall extending upwardly from the end of the bottom wall remote from the tower. The trays are arranged in vertically spaced-apart circumferential rows, the trays in each such row being spaced apart from each other, and the trays in adjacent rows are offset circumferentially from each other. All of the trays are disposed such that the planar surfaces slope downwardly from the end adjacent the tower to the end remote from the tower obliquely to diametrical planes of the tower. Packages for use with the display comprise nestable components that permit the articles to be clearly observed.

22 Claims, 6 Drawing Sheets

FREE-STANDING MERCHANDISE DISPLAY

BACKGROUND OF THE INVENTION

A popular way of displaying merchandise is a rotational, or carousel type free-standing display. The supplier has an opportunity to have its goods displayed separately from the merchandise of other suppliers, usually with signing to draw attention to its goods. The display is often set apart from the retailer's shelves where it is more readily noticed by shoppers. From the retailer's point of view separate rotational displays, because they are furnished by the supplier, reduce the cost of fixtures and often increase sales of the merchandise.

Many free-standing merchandise displays of the carousel type have a central support that rotates on a base and has rods from which the goods hang, the goods being packaged in blister cards, plastic bags or the like. Another form of rotating support commonly used in carousel displays comprises shelves for the packaged goods, which are often packaged so that part of the goods can be seen—e.g., window boxes, boxes with transparent covers, etc. Frequently, the merchandise is held in carousel displays in radial rows of several articles. As the stock is selected and removed by purchasers, the remaining articles in each radial row become less and less visible, because they stand in from the perimeter of the overall display. As the goods become less visible, the less likely are they to be observed by the customers. It is the most popular articles in the display that most quickly become less prominent to passersby, and the effectiveness of the display in driving sales is greatly diminished.

Economical manufacture and shipping, and easy setup, are important goals for display systems, as are good lighting, high density and easily visible products.

SUMMARY OF THE INVENTION

An object of the present invention is to provide a display that is mechanically configured to present all articles in the display at the perimeter where they will be equally visible. Another object is to provide a display in which the articles are presented at a relatively high density but without any articles being obscured. It is also desired to provide an opportunity for customers to remove the merchandise from the display and examine it apart from its packaging and, at the same time, to have attractive packaging incorporated in the display that the purchaser removes with the article and is readily closed to form a package for fully containing the article.

The foregoing and other objects are attained, according to the present invention, by modular merchandise display with individual merchandise item support trays, wherein the modules fit together so as to circumferentially offset trays of each higher module to avoid an upper tray interfering with removal of an item from a lower tray. A base adapted to rest stably on a surface, a pole extending vertically upwardly from the base, an elongated substantially circular cylindrical tower of modules rotatably mounted on the pole, and a multiplicity of elongated merchandise trays attached to and extending lengthwise generally radially outwardly from the tower are elements of the display. Each tray has a bottom wall, at least portions of which form a bottom surface or surfaces for supporting the merchandise item. Tray side walls extend upwardly from each of the longer sides of the bottom wall and an end wall extends upwardly from the end of the bottom wall remote from the tower. The trays are arranged in vertically spaced-apart circumferential rows, the trays in each such row are spaced apart from each other. The trays in adjacent rows are offset circumferentially from each other by means of keying provisions that cause the modules to fit together at an offset angle. All of the trays are disposed such that the planar bottom surfaces slope downwardly lengthwise from the end adjacent the tower to the end remote from the tower. Preferably, all of the trays are tilted sideways somewhat, i.e. disposed such that the planar bottom surfaces lie obliquely to diametrical planes of the tower in directions laterally of the trays. The packaged merchandise item slides to the outermost position on each tray, particularly when the display is rotated. The item also reclines or leans back against a side wall, improving visibility of lower items and given the display and merchandise a distinctive and eye-catching appearance.

In a preferred embodiment of the invention the modules of the tower are identical, stacked one on top of the other. Each module has a pair of identical pan-like members, each of which has a transverse wall portion (or pan bottom) and a generally circumferential wall portion (pan side). Each module is formed by two of the pan members, joined along the edges of their circumferential wall portions. The transverse wall portion of each pan member has a keying hole and a keying boss each spaced equally radially from the central axis of the pan member. The keying hole and keying boss are spaced apart circumferentially at a predetermined angle (other than 180°) such that in the stack of modules, for all but the lowest module. A key boss of each module is received in a key hole of the module below it, and each module is disposed in a position rotationally offset from the module below it. Each module has a circumferential row of trays attached to it, and the rows of trays are attached to all modules in corresponding positions and orientations. The trays in each row are spaced apart equidistantly from each other. The angular offset provided by the keying means, the boss and hole, cause the trays of adjourning modules to be offset.

The merchandise displayed in the display device is packaged in a unique package that is coordinated with the display. The package has two components, each of which has planar triangular side walls on each side of a rectangular opening formed by the longest edges of the side walls. The components are geometrically similar, but one is slightly smaller than the other so that it nests in the larger one. The two components are nested with the interior of the smaller component physically accessible through its opening, and the article is received in the smaller component such that as much as half of it is visible and projects from the opening. The article is thus easily removed from the package and inspected by a shopper. The smaller component of the package has laterally offset flanges along the longest edges of the triangular walls that mate with the longest edges of the larger component so that the two components can be assembled with the edges of their openings meeting to form a closed box for the article. A suitable fastening device is attached to one of the components and is displaceable into engagement with the other component to fasten together the components when they form the closed box. In one embodiment, the fastening device is an elongate elastic cord attached at each of its ends to one of the components near each end of the rectangular opening. The cord stretches over the remaining component to hold the box closed. In another embodiment adhesive or mechanical tabs secure the box components together.

The display apparatus is unique as a merchandising tool. Most retail fixtures display selected "facings" of products, i.e. outermost products visible to the shopper, with the balance of the stock behind these facings. Soon after the display has been "shopped", the back-up articles no longer relate to the facing. The display of the present invention, on the other hand, offers every one of the articles remaining in the stock at the display facing where it is clearly visible. This makes the display uniquely shopper-friendly. The consumer can rotate the display and see and touch, particularly with, the preferred packages, all of the articles. With the preferred packages making as much as half of each article is clearly visible, the shopper can evaluate the nature and quality of the article. Virtually all of the distinguishing features of the article are visible if the article is symmetrical. If a shopper should remove an article in the package and replace it and its package in a position set back from the outward end of its tray, the packaged article will either immediately slide along the sloping tray back to the facing or will be impelled by centrifugal force to the facing position at outer edge when the tower is rotated.

The base that stably supports the display can be of such a height that the lowest items are clearly visible and easily within the reach of the shopper without excessive stooping. Each pan member of each module has a central recessed seat for an annular bushing surrounding an opening through which the central pole extends. Bushings can be placed into at least each module's upper pan member bushing seat. Variations in pole diameter can be accommodated by selection of appropriate bushing inside diameters. The pole can be in two pieces, joined centrally by suitable fastening means to facilitate shipping and handling. Supported by the pole, the uppermost member of the display, the header, has an outer cylindrical or frusto-conical surface that can carry advertising radially inward of the outer surface, the header may be open to allow light from above through to the merchandise on display. The open area of the header also allows merchandise to be supported on the uppermost trays just below the header and yet be lifted upward to be removed from the trays without interference.

The preferred modular construction of the display offers economies in manufacture. The pan-like members are economically produced by injection-molding from a suitable plastic. Because they are of comparatively small size, the molds are not costly, and production rates are high. Similarly, the trays are best made of plastic by injection molding, with similar advantages. The packages may be produced from boxboard or plastic or a combination. For example, the larger component may be made from boxboard and the smaller from a clear plastic. Instead of displaying the articles in the nested, open box, the retailer may, at his option, display the package in its closed configuration, in which case the articles can still be seen through the transparent smaller package component. Even when the package is displayed in the nested, open configuration, it provides convenience and time-savings at the check-out counter, because the clerk can quickly close and secure the package. The larger component is separated from the smaller component and placed edge-to-edge on the smaller component, and the fastener or fasteners brought into position. The purchaser then leaves with an attractive closed package, which may be used as a gift wrapping.

For a better understanding of the invention reference may be made to the following description of an exemplary embodiment, taken in conjunction with the accompanying drawings.

DESCRIPTION OF THE EMBODIMENT

Figure 1:
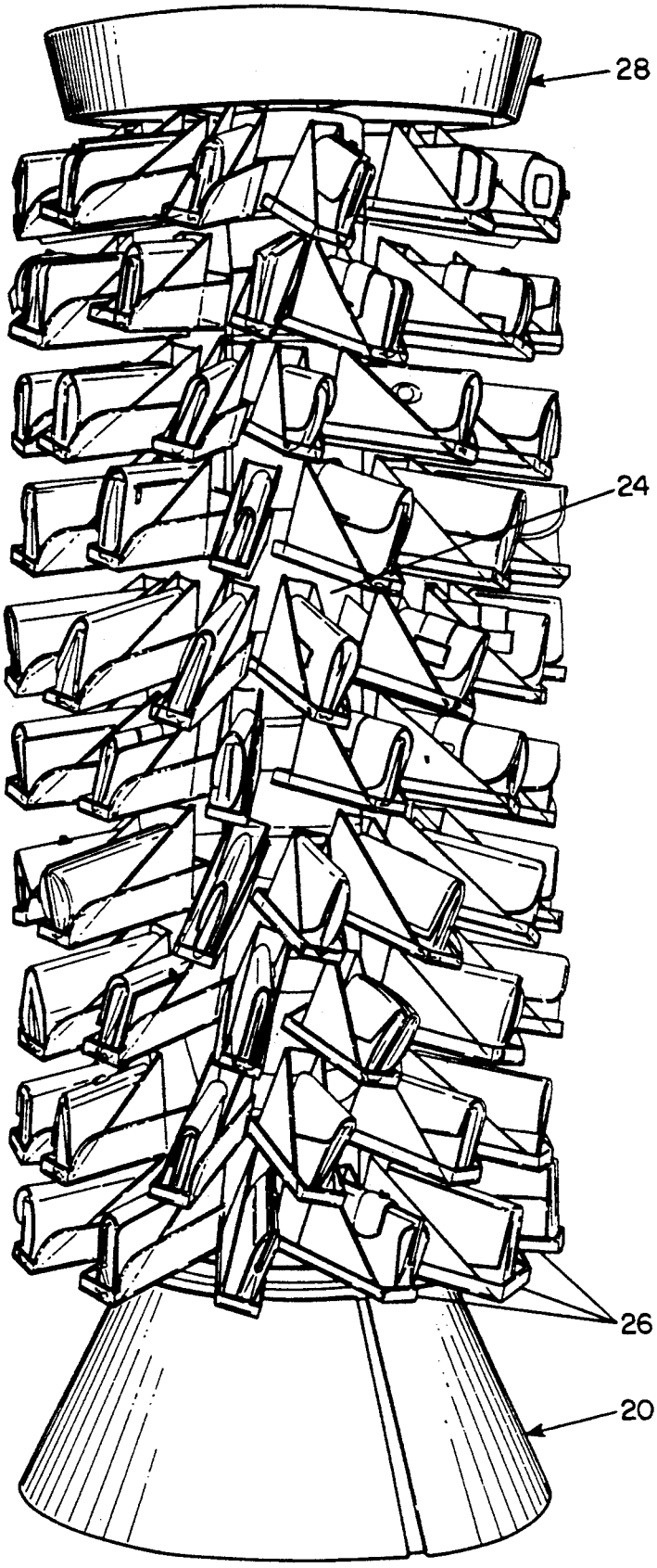
FIG. 1 is a perspective view of a display system according to the invention, and shows the trays of the display filled with merchandise.
Figure 1A:
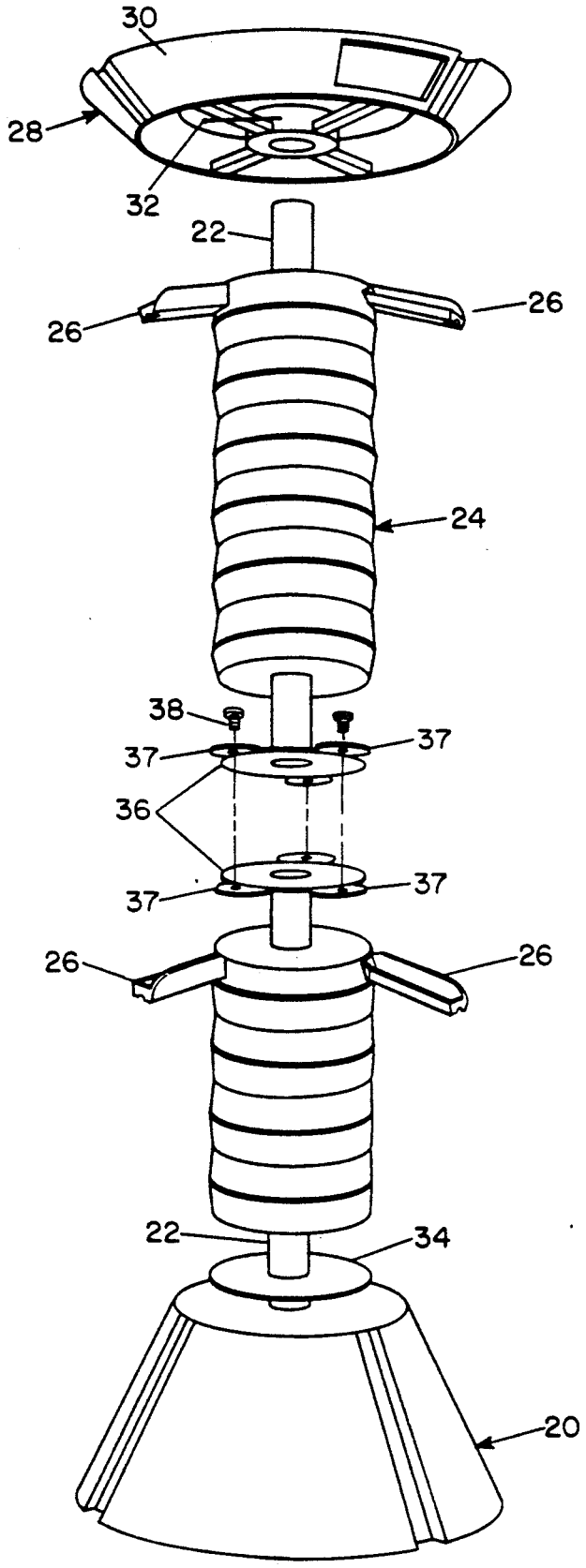
FIG. 1A is an exploded perspective view of the display, with most of the trays are omitted for clarity.

The main components of the display, as shown in FIGS. 1 and 1A, are a base 20, a vertical pole 22 affixed to the base, a tower 24 rotatably received on the pole and carrying a large number of trays 26, and a decorative header 28. The base and pole may be of any convenient construction, and the base is designed to rest stably on a floor. The header rests on top of the pole and is open between a frusto-conical ring 30, on which promotional material for the goods is displayed, and a central support 32 so that light can pass down to the trays from above. The tower 24, which is described in detail below, is mounted on a bearing mount 34 so that the customers can rotate it. For convenience and economy in shipping, the display is assembled in two sub-assemblies, which may be joined by means of splice discs 36 attached to two sections of the pole 22 and fasteners 38. The discs 36 have aligned projecting tabs 37 into which the fasteners 38 are received.

Figure 2:
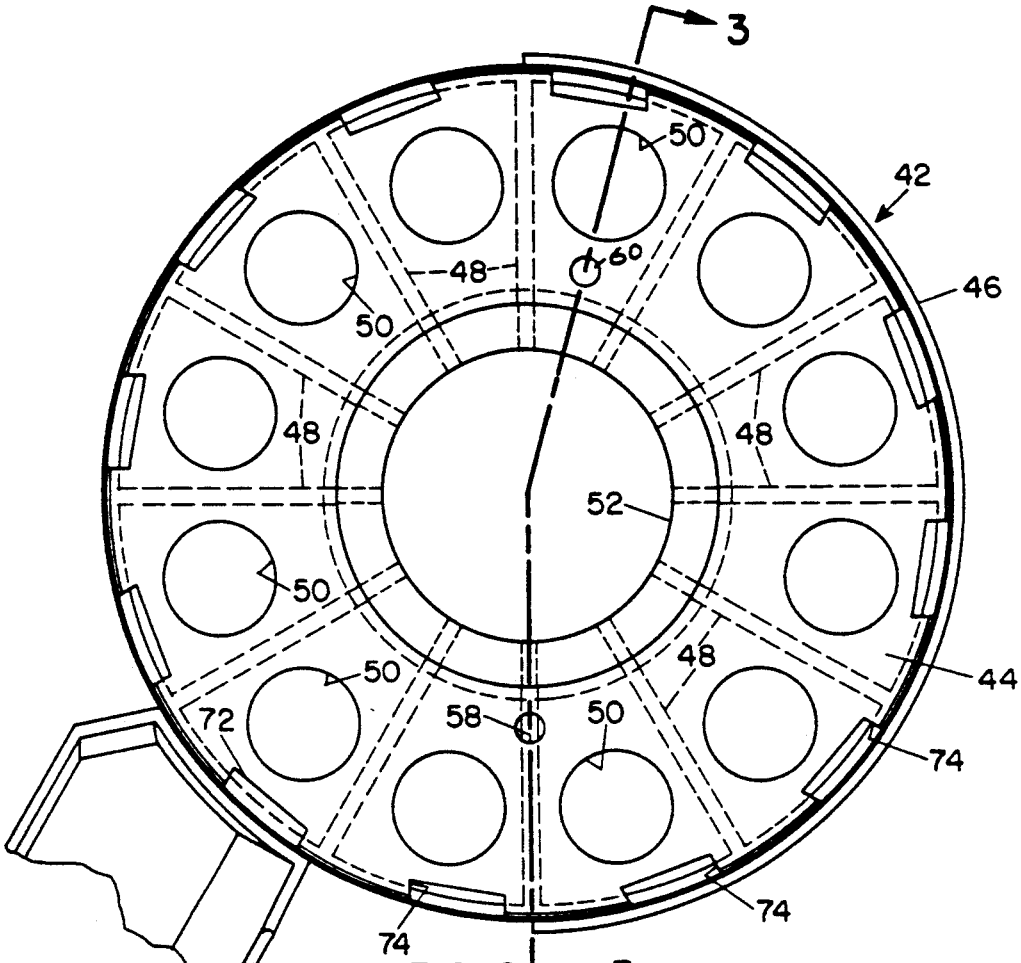
FIG. 2 is a bottom plan view of one of the pan-like members of a tower module and a portion of one of the trays.
Figure 3:
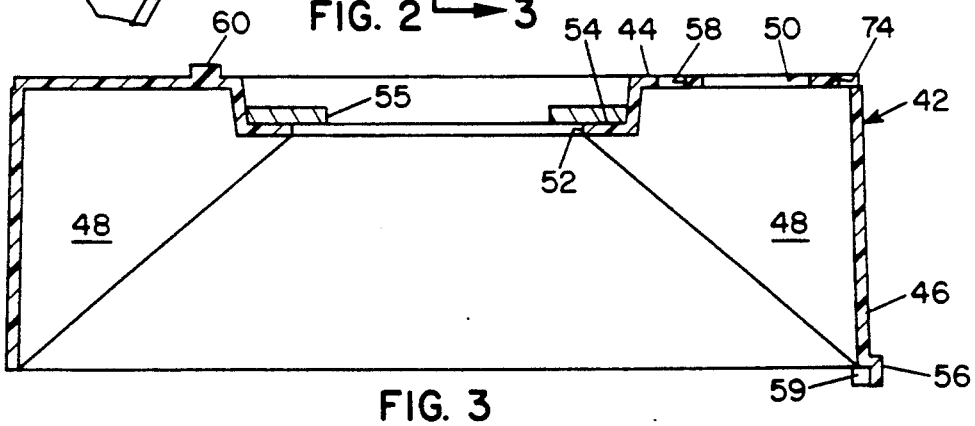
FIG. 3 is a side cross-sectional view of the pan-like member taken along a broken plane represented by the lines 3—3 of FIG. 2.
Figure 4:
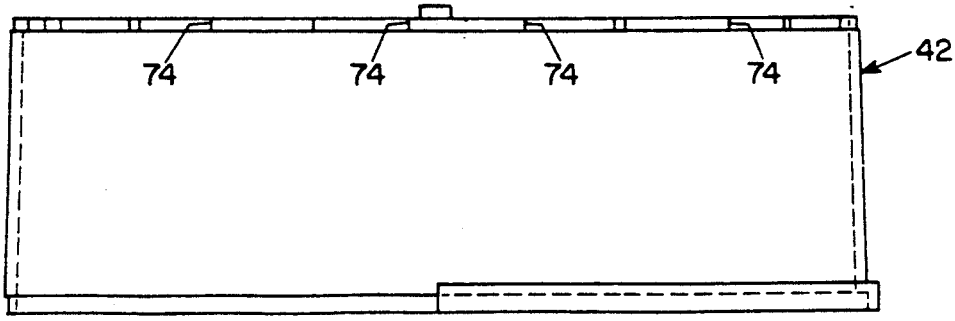
FIG. 4 is a side elevational view of the pan-like member.
Figure 5:
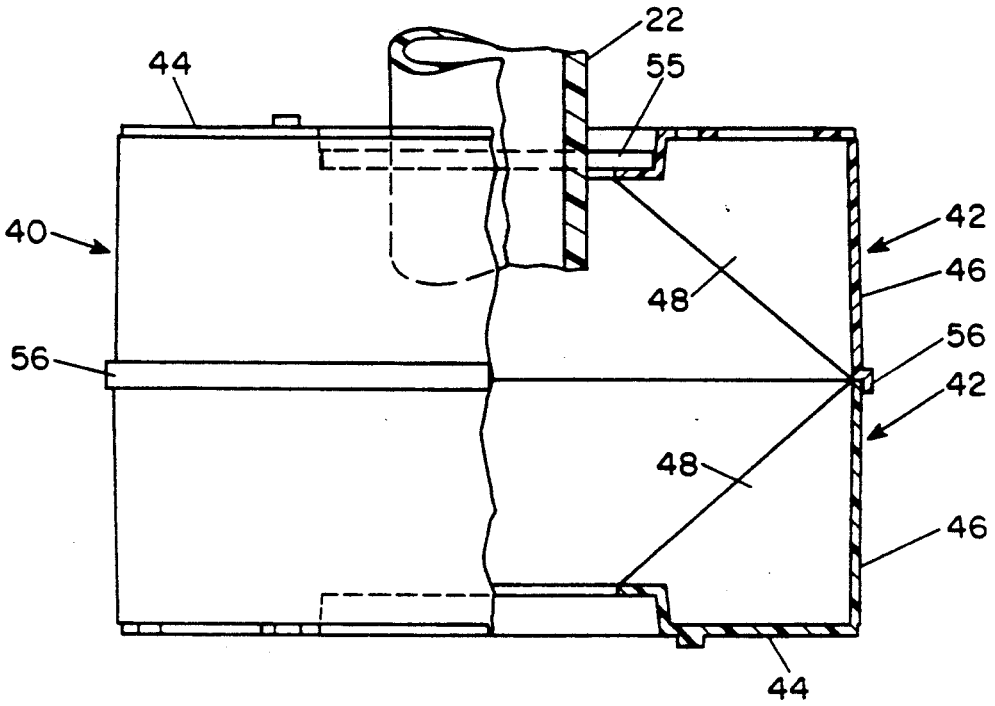
FIG. 5 is a side half cross-sectional view of a tower module.

The tower 24 is a stack of identical, substantially cylindrical modules 40, one of which is shown in FIG. 5. Each module, in turn, consists of two identical pan-like members 42 that are joined together at corresponding ends. Referring to FIGS. 2 to 4, each pan-like member includes a circular base wall portion 44 and a substantially cylindrical peripheral wall portion 46. It is injection-molded from a suitable plastic, so the peripheral wall has a slight taper to facilitate parting of the piece from the mold. Equally spaced-apart, radially extending ribs 48 of generally triangular shape join the base wall and the peripheral wall. Holes 50 in the base wall reduce the weight of the piece and eliminate material. A circular hole 52 in the center of the base wall receives the pole 22. A recessed flange 54 surrounds the hole 52. In at least the upper pan of any module the recessed flange receives an annular disc 55 that serves as a bushing between the pan and the pole 22, as shown in FIG. 5. The ability to choose among various bushing inside diameters makes the design tolerant to variations in the diameter of the pole 22, which can vary considerably if purchased as a stock item from various sources. A flange 56 set out radially from the perimeter of the free edge of the peripheral wall of the pan-like member and extending along half of the perimeter provides a land area 59 (FIG. 3) for the plain (or unflanged) one-half of the edge of the peripheral wall of the other member of the module when the two members are assembled edge to edge. The two members are joined, such as by chemical or thermal bonding.

The base wall of each pan-like member has a hole 58 and a boss 60, both of which are located the same distance radially from the center. The included angle between radial lines through the centers of the hole and the boss is less than 180 degrees, and the boss of one member is sized to fit closely into the hole of another. When the modules 42 are stacked to form the tower 24, each module is placed on the one below it with its boss received in the hole of the lower module, and vice versa. Because the angular spacing between the hole and boss of each base wall is less than 180 degrees, each successive module 42 in the tower is positioned circumferentially with an offset relative to the adjacent modules. As will more fully appear from the description below, the circumferential offset is essentially half the angular spacing between circumferentially displaced trays. The positions of the trays carried by each module are thus offset from those carried by the modules above and below.

The trays 26 (FIGS. 6 to 10) are elongated boxes that are open at the top and include an inner end wall 62, an outer end wall 64, right and left side walls 66 and 68, and a bottom wall 70. All of the trays of the display are identical and are, preferably, made of a clear plastic by injection molding. The use of clear plastic allows light to pass through them for enhanced visibility of the goods on display. The inner end wall is curved transversely to match the curvature of the peripheral wall of the pan-like member of the tower, to which it is fitted and attached. Proper positioning of the tray to the member upon assembly is facilitated by a L-shaped lug 72 that projects from the inner end wall and is received in a slot or socket 74 at the juncture of the base wall and side wall of the upper member of the module. In addition to joinder of the trays to the modules by the lugs and sockets, they are also fastened by chemical or thermal bonding. The layer and sockets assure proper location of the trays on the modules.

Each module has equally spaced-apart sockets 74, thereby providing for the mounting of a corresponding number of equally spaced-apart trays 26 in a circumferential row along the perimeter wall of the module. Because the modules are offset circumferentially from each other when stacked to make the tower, and because the bosses 60 and holes 58 fix the positions of the trays as described above the trays of a module are offset circumferentially from the trays of the module above or below it. This allows a great density of products being displayed to be more easily seen, and placed in and removed from the trays. Put another way, because they are offset circumferentially, one level of trays can be closer to the next lower layer without interfering when a product is lifted up and out of a tray by a shopper. This contributes to more products being displayed.

The bottom wall 70 of each tray 26 (see FIGS. 6 to 10) has a longitudinally extending concavity 76 flanked on either side by surfaces 78 and 80 that lie in a common plane and upon which the goods on display rest. Longitudinal cutouts 82 along each side of the bottom lighten the weight, reduce the amount of material (for reduced cost), reduce the friction between the goods and the tray bottom and help avoid accumulation of dust and trash. In this regard a package rests on the flat surfaces 78 and 80, so it readily slides along the bottom. The planar surfaces 78 and 80 lie at an angle that is oblique to both the line that is the center of curvature of the inner wall 62 and to a plane perpendicular to that line—in other words the planar surfaces are oblique to the axis of the tower and to planes perpendicular to the axis of the tower. Thus the tray bottoms slope downwardly and outwardly from the tower so that the products slide readily to the outer ends of the trays, especially when the display is rotated and centrifugal force acts on the products.

Figure 9:
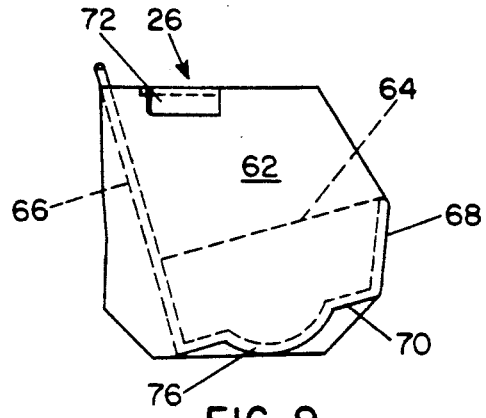
FIG. 9 is an elevational view of the end of the tray that is attached to the column.
Figure 10:
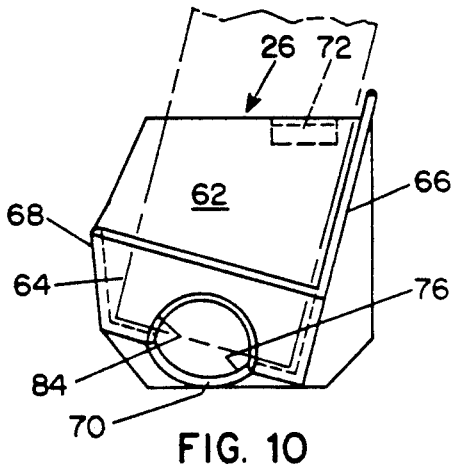
FIG. 10 is an elevational view of the free or outer end of the tray.
Figure 11:
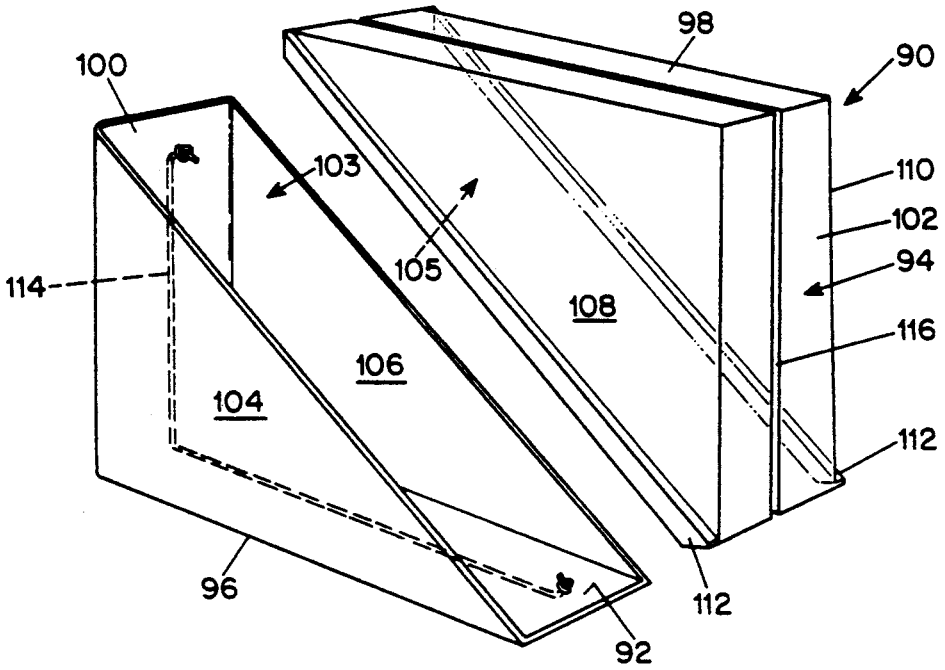
FIG. 11 is an exploded perspective view of a package for the display.
Figure 12:
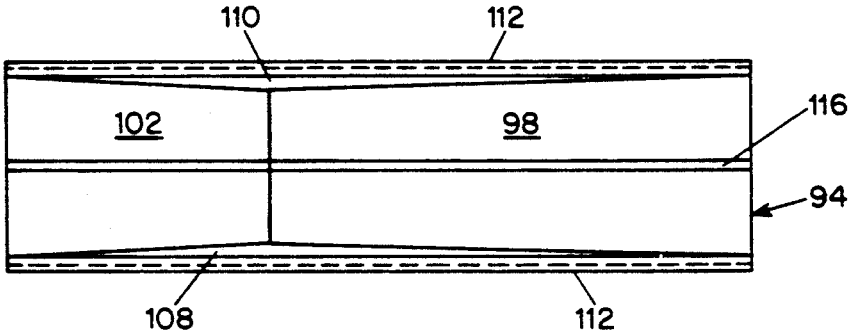
FIGS. 12 13 and 14 are top plan, side elevational, and end elevational views, respectively, of the smaller component of the package.
Figure 13:
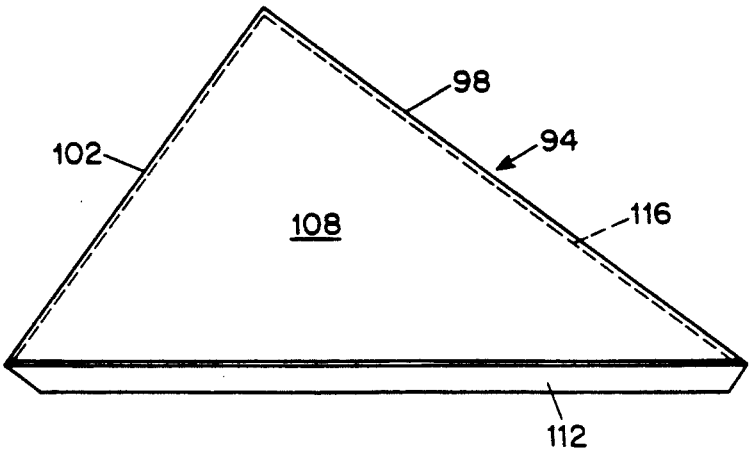
Figure 14:
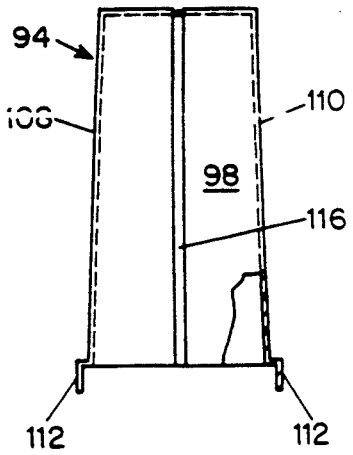

The tray bottoms also slope laterally, as best seen in FIGS. 9 and 10, so that the product, in its package leans back against the side wall 66, as indicated in phantom outline in FIG. 10. The right wall 66 is somewhat taller than the left wall 68, and since the products tend to rest against the right wall because of the slope of the bottom, they are well supported on that side. The right wall is perpendicular to the bottom plane of the tray, conforming to the perpendicularly related bottom and side wall of the package (described below). The left wall lies obliquely to the bottom plane such that it diverges upwardly, relative to the right wall, which facilitates inserting the packages into the trays and also makes a greater portion of each package easily visible. The longitudinal concavity 76 along the bottom of each tray adds structural integrity, resisting flexure, and it accommodates an elastic closure member or cord used in a preferred embodiment of the invention as described below. A cutout 84 in the outer end wall and bottom wall enables the customer to insert a finger and push up the package in the tray for ease of removing it.

Figure 15:
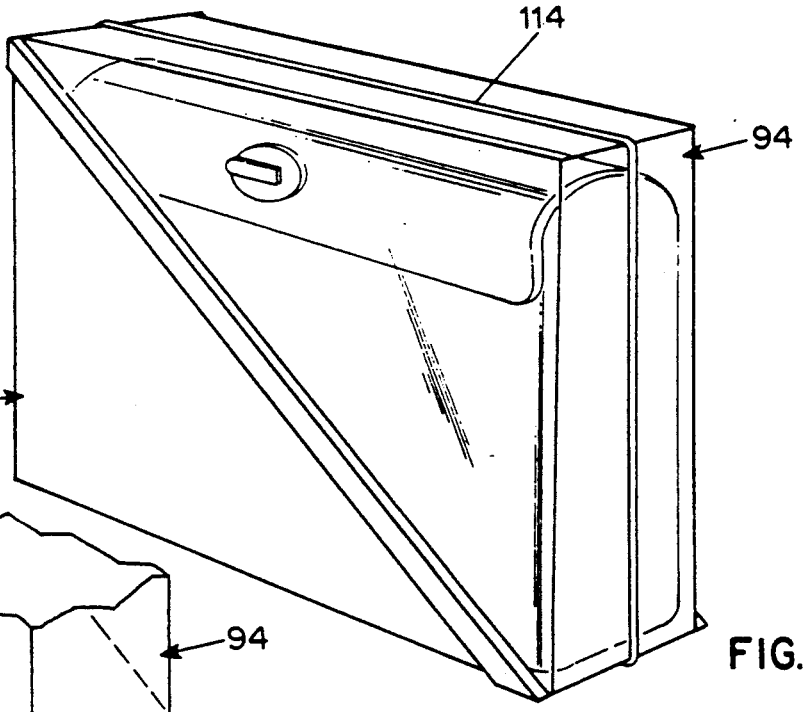
FIG. 15 is a perspective view of the package in its closed and secured condition.

Although the display is well suited for displaying articles in a variety of forms of packaging, the packages shown in FIGS. 11 to 15 provide an especially effective marketing medium in conjunction with the display carousel. Each package 90 consists of two components 92 and 94, each of which has, respectively, a rectangular planar base wall 96, 98, a rectangular planar end wall 100, 102 and planar triangular side walls 104 and 106, 108 and 110. The side walls are joined along corresponding edges to the base and end walls to form open boxes having a rectangular opening 103 and 105 formed in each case by the longest edges of the side walls, one edge of the base wall and one edge of the end wall. The components are geometrically similar, and one, the component 94 in this example, is slightly smaller than the other. For displaying the articles, the smaller component is nested in the larger one with their openings contiguous and the article is placed in the smaller component such that at least one half of it is visible and so that it may be removed from the package and inspected by a potential purchaser. The smaller component 94 of the package has laterally offset flanges 112 along the longest edges of the triangular side walls that mate with the longest edges of the triangular side walls of the larger component so that the two components can be assembled with the edges of their openings meeting to form a closed box for the article (FIG. 15).

The components of the package 90 can be made of boxboard or injection-molded plastic. In the illustrated embodiment the larger component 92 is boxboard and the smaller 94 transparent plastic. This combination provides the retailer with the option of displaying the articles with the packages closed. The shoppers can still see the articles through the transparent component.

For convenience at the retail cashier's station, it is desirable to include in the package system a device or devices for fastening the two components when the box is closed. As shown in FIG. 15, the fastener device consists of an elastic band 114 having its ends passed through holes in the base and end walls near the edges, knotted or otherwise secured at its ends inside the component 92, and looped outside of the base and end walls when the article is displayed as shown in FIG. 15. The concavities 76 in the bottom walls 70 of the trays of the carousel display allow the packages to rest on the tray bottom with the bands received in the concavities so that the bands do not interfere with the sliding of the packages on the tray surfaces. After the components are placed together to close the package, the elastic band 114 is pulled around over the smaller component, which has a groove 116 (FIG. 11) along the center of the base and end walls that receives the band and retains it in place. Because the edges of the opening 103 of the larger component 92 and the engaging flanges 112 of component 94 are slidably engaged, some adjustment of the length and height of these packages is possible to accommodate items that do not precisely conform to a particular set of dimensions.

Figure 16:
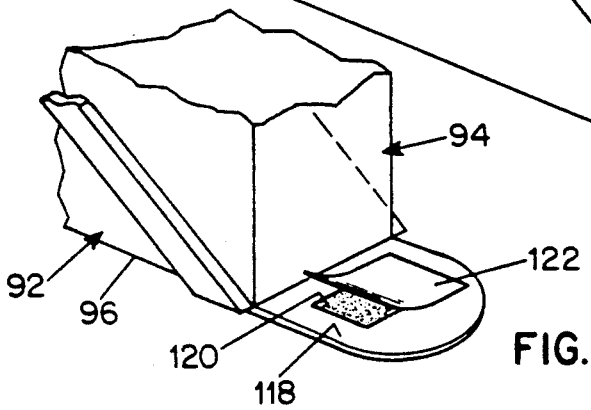
FIG. 16 is a fragmentary perspective view of a package with an alternative closure.
Figure 6:
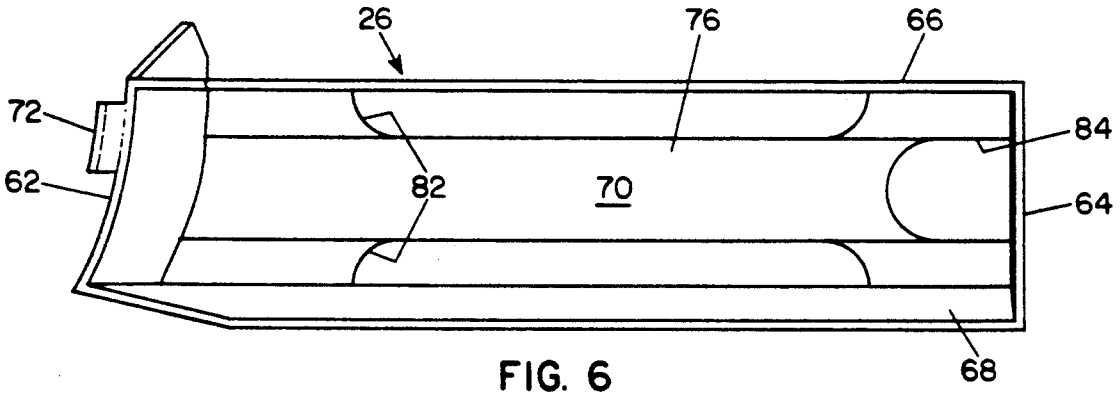
FIG. 6 is a top plan view of a tray taken orthogonally to the bottom wall.
Figure 7:
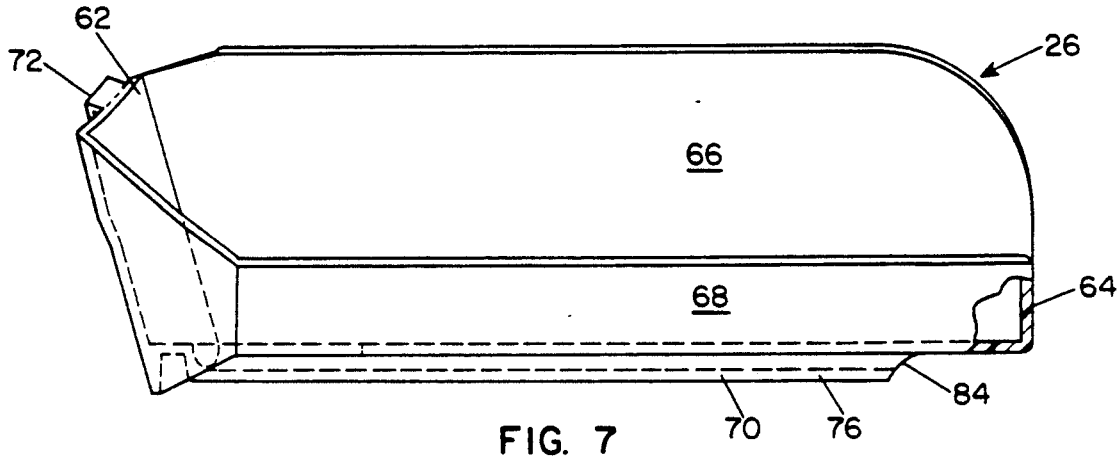
FIG. 7 is a side elevational view of the left side of the tray taken orthogonally to the right wall.
Figure 8:
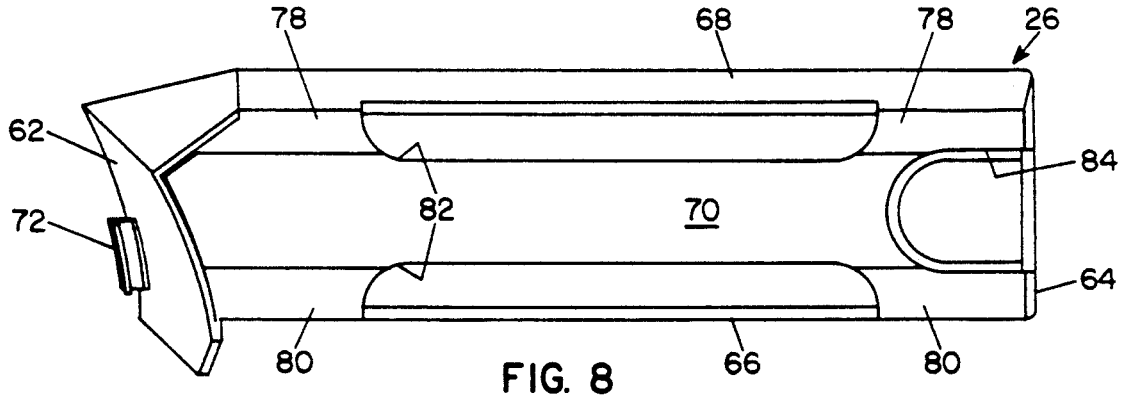
FIG. 8 is a bottom plan view of the tray taken orthogonally to the bottom wall.

In another example, shown in FIG. 16, the larger component may have fold-out tabs 118 (one of which is shown) on the edges of the base wall 96 and end wall 100, at the opening 103, each of which has a patch of adhesive 120 covered by a removable strip 122. The tab 118 can be folded into the component for display. To close the package, the tabs are pulled out, the strips 122 removed, and the tabs pressed against the respective base and end walls 98 and 102 of the smaller component.

The above-described embodiment of the invention is merely exemplary, and those skilled in the art will be able to make numerous modifications and variations of the embodiment without departing from the spirit and scope of the invention. All such variations and modifications are intended to be included within the scope of the invention, as defined in the appended claims.

I claim:

1. A modular merchandise display including a series of central modules interconnectable to form an upstanding central support, individual outwardly projecting merchandise item support trays on the modules, keying means on the modules for establishing an offset angular relation between adjoining modules whereby trays of adjoining modules are offset circumferentially, and means for rotationally supporting the central modules for rotation;

the means for rotationally supporting including an upright central pole, each said modules having a central opening therethrough for receiving the pole;

the pole being a two-piece pole including means for joining the two pieces thereof centrally;

the means for joining the two pieces centrally including radial outward projections at adjoining ends of each of the two pieces, and fastening means for fastening together the projections thereby to join the two pieces of the pole end-to-end.

2. A modular merchandise display including a series of central modules interconnectable to form an upstanding central support, individual outwardly projecting merchandise item support trays on the modules, keying means on the modules for establishing an offset angular relation between adjoining modules whereby trays of adjoining modules are offset circumferentially, and means for rotationally supporting the central modules for rotation;

the means for rotationally supporting including an upright central pole, each said modules having a central opening therethrough for receiving the pole;

each module having a seat for an annular bushing surrounding the opening for receiving the pole, the opening having an inside diameter substantially larger than the outside diameter of the pole, said bushing having an inside diameter closer in dimension to the outside diameter of the pole than said module opening inside diameter.

3. A modular merchandise display according to claim 1 wherein the keying means includes an interfitting projection and recess on adjoining modules establishing the angular relationship at which they are joined.

4. A modular merchandise display according to claim 2 further comprising a base module affixed to said pole and securing the pole in an upright position, the modules being rotatable about the pole, and the display further comprising a header module secured to the pole to form the uppermost limit of the display.

5. A modular merchandise display according to claim 4 wherein the header extends outward from the pole over the modules, the header having an open area inward of its circumference permitting light from above to illuminate the items displayed.

6. A modular merchandise display according to claim 5 wherein each of said modules supports a plurality of the individual merchandise item support trays circumferentially spaced thereon, the trays projecting generally radially outward from the module and having downward and outward sloping merchandise support surfaces facilitating sliding movement of the item towards the outward end of the tray.

7. A merchandise display of the kind including an upstanding central support means for supporting individual items of merchandise and including a means for rotationally supporting the upstanding central support means to enable turning of the support means and merchandise thereon to bring the individual items into position for observation, wherein the improvement comprises:

plural merchandise item retaining means for retaining the individual items removably and replaceably on display; and item supporting surfaces on said merchandise item retaining means having a front edge, a first side edge, and a second side edge disposed opposite to the first side edge and having a higher side than the first side edge, wherein said item supporting surface extends outward and away from the upstanding central support means and wherein said supporting surface is tilted downward and laterally toward the second side edge having a higher side than the first side edge;

whereby the supporting surfaces facilitate the sliding of the displayed items outward to a display location proximate to the edges of the item supporting surfaces and whereby the displayed items are urged to lean away from the first side and rest against the second side edge such that greater visibility is provided to the displayed item at the first side edge having the side lower than the second side edge.

8. The display according to claim 7 further comprising means for limiting the sliding of the displayed items outward to thereby define a display location proximate the outward extremity of the merchandise item retaining means.

9. The display according to claim 8 wherein the merchandise item retaining means comprises a plurality of individual merchandise trays attached to and extending generally radially outwardly from the central support means.

10. The display according to claim 7 wherein the plural merchandise item retaining means each project generally radially from the central support means, each has a retaining side surface, and the surfaces on the merchandise retaining means extending outward and downward are inclined in a direction transverse to the general radial direction of projection of the retaining means to cause a supported merchandise item to lean against the retaining side surface.

11. A free-standing merchandise display comprising a base adapted to rest stably on a horizontal surface, a pole extending vertically upwardly from the base, an elongated substantially circular cylindrical tower rotatably mounted on the pole, and a multiplicity of elongated merchandise trays attached to and extending lengthwise generally radially outwardly from the tower, each tray having a bottom wall, at least portions of which form a planar surface for supporting the merchandise, side walls extending upwardly from each of the longer sides of the bottom wall and an end wall extending upwardly from the end of the bottom wall remote from the tower, the trays being arranged in vertically spaced-apart circumferential rows, the trays in each such row being spaced apart from each other, the trays in adjacent rows being offset circumferentially from each other and all of the trays being disposed such that the planar surfaces slope downwardly from the end adjacent the tower to the end remote from the tower obliquely to diametrical planes of the tower.

12. A display according to claim 11 wherein all of the trays are disposed such that the planar surfaces lie obliquely to diametrical planes of the tower in directions laterally of the trays.

13. A display according to claim 11 wherein the tower is composed of a multiplicity of identical modules stacked one on top of the other.

14. A display according to claim 13 wherein each module consists of a pair of identical pan-like members, each having a transverse wall portion and a circumferential wall portion, the peripheral wall portions of the members of each module being joined at their corresponding ends.

15. A display according to claim 14 wherein the transverse wall portion of each member of each module is attached to the end of the circumferential wall portion remote from the joined ends, and the transverse wall portion of each member has a keying hole and a keying boss spaced apart equidistantly from the axis of the circumferential wall portion, the keying hole and keying boss being spaced apart circumferentially at a predetermined angle such that in the stack of modules a key boss of each module is received in a key hole of the module below it and each module is disposed in a position rotationally offset by said predetermined angle from the module below it.

16. A display according to claim 15 wherein each module has a circumferential row of trays attached to it, and the rows of trays are attached to all modules in corresponding positions and orientations.

17. A display according to claim 16 wherein the trays in each row are spaced apart equidistantly from each other.

18. A display according to claim 11 and further comprising packaged merchandise articles received in at least some of the trays, the package for each article consisting of two components, each of which has a rectangular planar base wall, a rectangular planar end wall and planar triangular side walls, said walls being joined along corresponding edges to form an open box having a rectangular opening formed by the longest edges of the side walls, one edge of the base wall and one edge of the end wall, the components being geometrically similar and one being slightly smaller than the other and nesting in the other with their openings contiguous and the article being received in the smaller components such that at least one half of it is visible and so that it may be removed from the package and inspected by a potential purchaser.

19. A display according to claim 18 wherein the smaller component of the package has laterally offset flanges along the longest edges of the triangular walls that mate with the longest edges of the larger component so that the two components can be assembled with the edges of their openings meeting to form a closed box for the article.

20. A display according to claim 11 and further comprising packaged merchandise articles received in at least some of the trays, the package for each article consisting of two components, each of which has a rectangular planar base wall, a rectangular planar end wall and planar triangular side walls, said walls being joined along corresponding edges to form an open box having a rectangular opening formed by the longest edges of the side walls, one edge of the base wall and one edge of the end wall, the components being geometrically similar and one being slightly smaller than the other and the smaller component having laterally offset flanges along the longest edges of the triangular walls that mate with the longest edges of the larger component, the two components being assembled with the edges of their openings meeting to form a closed box for the article and the smaller component being transparent so that at least one half of the article is visible for inspection.

21. A display according to claim 18 and further comprising means attached to one of the components and displaceable relative thereto into engagement with the other component for joining the components together when they are assembled to form a closed box.

22. A merchandise display of the kind including an upstanding central support means for supporting individual items of merchandise, means for rotationally supporting the upstanding central support means to enable turning of the support means and merchandise thereon to bring the individual items into position for observation, the improvement comprising:

plural merchandise item retaining means for retaining the individual items removably and replaceably on display;

item supporting surfaces on said merchandise item retaining means extending outward and downward away from the upstanding central support means, whereby the supporting surfaces facilitate sliding of the displayed items outward to a display location proximate outward ends of the item supporting surfaces;

means for limiting the sliding of the displayed items outward to thereby define a display location proximate the outward extremity of the merchandise item retaining means;

the merchandise item retaining means comprising a plurality of individual merchandise trays attached to and extending generally radially outwardly from the central support means, and said trays comprising means for supporting the merchandise items from below, adapted to permit removal of the items upward, the display having the trays disposed at a plurality of higher and lower levels, higher level trays being circumferentially offset from trays in a next lower level to facilitate upward removal of the item displayed at the next lower level.

* * * * *